US009669511B2

(12) United States Patent
Hirayama et al.

(10) Patent No.: US 9,669,511 B2
(45) Date of Patent: Jun. 6, 2017

(54) SURFACE GRINDING METHOD FOR WORKPIECE

(71) Applicant: KOYO MACHINE INDUSTRIES CO., LTD., Yao-shi (JP)

(72) Inventors: Haruyuki Hirayama, Yao (JP); Kazuhiro Yusou, Yao (JP)

(73) Assignee: KOYO MACHINE INDUSTRIES CO., LTD., Yao-shi (JP)

( * ) Notice: Subject to any disclaimer, the term of this patent is extended or adjusted under 35 U.S.C. 154(b) by 0 days.

(21) Appl. No.: 14/628,615

(22) Filed: Feb. 23, 2015

(65) Prior Publication Data

US 2015/0239089 A1 Aug. 27, 2015

(30) Foreign Application Priority Data

Feb. 25, 2014 (JP) ..... 2014-034659

(51) Int. Cl.

| | |
|---|---|
| ***B24B 37/005*** | (2012.01) |
| ***B24B 37/10*** | (2012.01) |
| ***B24B 57/02*** | (2006.01) |
| ***B24B 37/04*** | (2012.01) |
| ***B24B 53/017*** | (2012.01) |

(52) U.S. Cl.

CPC ..... *B24B 37/042* (2013.01); *B24B 37/005* (2013.01); *B24B 37/10* (2013.01); *B24B 53/017* (2013.01); *B24B 57/02* (2013.01)

(58) Field of Classification Search

CPC ..... B24B 37/005; B24B 37/042; B24B 37/10; B24B 53/017; B24B 53/065; B24B 57/02

USPC ..... 451/36, 41, 54, 285, 287, 443, 446

See application file for complete search history.

(56) References Cited

U.S. PATENT DOCUMENTS

| | | | | |
|---|---|---|---|---|
| 2,916,858 | A * | 12/1959 | Hudson | B24B 3/34 451/281 |
| 3,863,398 | A * | 2/1975 | Moser | B24B 47/10 451/294 |
| 6,043,961 | A * | 3/2000 | Yamamoto | B24B 7/16 360/131 |
| 6,132,295 | A * | 10/2000 | Tietz | B24B 7/228 451/287 |
| 6,402,588 | B1 * | 6/2002 | Matsuo | B24B 7/228 451/21 |
| 2003/0017794 | A1 * | 1/2003 | Kozakai | B24B 13/0037 351/159.76 |

(Continued)

FOREIGN PATENT DOCUMENTS

JP 2013-222935 A1 10/2013

*Primary Examiner* — Eileen Morgan

(74) *Attorney, Agent, or Firm* — Kratz, Quintos & Hanson, LLP

(57) ABSTRACT

[Problem] To machine a workpiece such as a hard brittle material or difficult-to-cut material innovatively and accurately and to improve the machining rate significantly.

[Solution Means] In grinding a workpiece W by a cup grinding wheel 3 while supplying a slurry 5 containing abrasive grains, the grinding wheel 3 is rotated at low peripheral speed. No more than 500 m/min., preferably 30 to 430 m/min., is appropriate for the peripheral speed of the grinding wheel 3. The slurry 5 at a flow rate of no more than 4.0 ml/cm$^2$/h, preferably of 1.0 to 2.0 ml/cm$^2$/h is dropped or sprayed little by little onto a ground surface of the workpiece W.

8 Claims, 4 Drawing Sheets

(56) References Cited

U.S. PATENT DOCUMENTS

| | | | | |
|---|---|---|---|---|
| 2004/0137834 | A1* | 7/2004 | Webb | B24D 3/28 451/526 |
| 2005/0173377 | A1* | 8/2005 | Pietsch | B24B 7/17 216/88 |
| 2011/0165823 | A1* | 7/2011 | Ide | B24B 37/00 451/41 |
| 2013/0023186 | A1* | 1/2013 | Motoshima | B24B 55/02 451/7 |
| 2015/0224621 | A1* | 8/2015 | Motoshima | B24B 55/02 451/7 |

* cited by examiner

SURFACE GRINDING METHOD FOR WORKPIECE

TECHNICAL FIELD

The present invention relates to a surface grinding method for a workpiece suitable for machining a workpiece of a hard brittle material such as a sapphire wafer and of a difficult-to-cut material.

BACKGROUND ART

When grinding a workpiece such as a sapphire wafer or a silicon wafer used for manufacturing a semiconductor device, a grinding wheel is fed into the workpiece and grinds it to a mirror-finished state while being rotated at high speed in a surface grinder equipped with a cup grinding wheel.

However, there is a problem in the case of the workpiece being a hard brittle material such as a sapphire wafer that the workpiece cannot be machined with high accuracy at a high machining rate. More specifically, where the workpiece is hard, the edge of the grinding wheel is difficult to work with respect to the workpiece, so that wear of abrasive grains during the grinding is advanced quickly and deterioration of the grinding wheel surface due to glazing, loading, and shedding becomes severe, and the grinding becomes impossible soon. As a result, the grinding wheel alone is worn out or becomes unable to be fed, and consequently, the grinding is carried out at a remarkably low machining rate. A grinding wheel on the order of #1500 or more has a problem that practical grinding of the hard workpiece is not available.

Solutions to this problem include development of a highly sharp grinding wheel and development of a machine with high rigidity allowing the grinding wheel to be fed strongly. In addition to such general solutions, there is a method that rotates the grinding wheel at high speed at a number of revolutions on the order of 6000 rpm to be fed to perform the grinding while supplying a slurry containing fine abrasive grains onto a ground surface of the workpiece (Patent Document 1).

PRIOR ART DOCUMENT

Patent Document

Patent Document 1: Japanese Published Unexamined Patent Application No. 2013-222935

SUMMARY OF THE INVENTION

Problems to be Solved by the Invention

This method of performing the grinding while supplying the slurry exhibits the effect of promoting self-sharpening of the grinding wheel by the abrasive grains within the fluid of the slurry. The grinding wheel can be expected to be fed with its sharpness as compared to when the grinding is carried out without supplying the slurry.

In the actual grinding of the workpiece of the hard brittle material, however, the grinding wheel rotates at high speed at a number of revolutions on the order of 6000 rpm in addition to that the difference in hardness between the workpiece and the abrasive grains of the grinding wheel is small. Consequently, the applicable range of the abrasive grains etc., of the grinding wheel becomes severe and it is difficult to use the grinding wheel in such a state that the abrasive grains appropriately perform self-sharpening during the grinding. As a result, the grinding wheel becomes unfit only with a slight change in machining conditions, and therefore, there is a problem that the workpiece cannot be ground with high accuracy such as deterioration of surface roughness and flatness (TTV) of the workpiece.

More specifically, if the abrasive grains of the grinding wheel are worn out and the grinding wheel becomes dull, the high speed rotation of the dull abrasive grains of the grinding wheel causes a brittle fracture such as forced scratching of the ground surface of the workpiece, and the surface roughness of the ground surface of the workpiece deteriorates. Since the dull grinding wheel rotates at high speed, heat generation in the workpiece and a chuck during the grinding becomes large. The workpiece is ground with the both thermally expanded, and thus, the flatness (TTV) of the workpiece after being ground deteriorates.

Especially when the workpiece is ground by the cup grinding wheel, an increase in temperature at the center part of the workpiece with which the grinding wheel is in constant contact is significant, and the workpiece is ground with the center part thermally expanded convexly. As a result, the surface of the workpiece having been ground becomes concave and the flatness deteriorates.

In view of such conventional problems, the present invention aims at providing a surface grinding method for a workpiece capable of machining a workpiece such as a hard brittle material or difficult-to-cut material innovatively and accurately and improving the machining rate remarkably.

Means for Solving the Problem

In the surface grinding method for the workpiece that grinds the workpiece by means of a cup grinding wheel while supplying a slurry containing abrasive grains, the present invention rotates the grinding wheel at low peripheral speed.

No more than 500 m/min., preferably 30 to 430 m/min., is appropriate for the peripheral speed of the grinding wheel.

The slurry is preferably dropped or sprayed onto the workpiece. Further, it is also acceptable that air injected from a spray nozzle is blown to the slurry while being dropped from a dropping pipe and the slurry is supplied to a ground portion of the workpiece while being blown off in a mist form.

The slurry at a flow rate of no more than 4.0 $ml/cm^2/h$, preferably of 1.0 to 2.0 $ml/cm^2/h$ is preferably supplied little by little.

For the workpiece, a hard brittle material or difficult-to-cut material is appropriate. Further, the slurry preferably contains the abrasive grains which promote self-sharpening of the grinding wheel during the grinding of the workpiece.

Effects of the Invention

According to the present invention, there are advantages that the workpiece such as the hard brittle material or difficult-to-cut material can be machined innovatively and accurately and the machining rate is improved remarkably.

MODES FOR CARRYING OUT THE INVENTION

Hereinafter, embodiments of the present invention will be described in detail based on the drawings.

Figure 1:
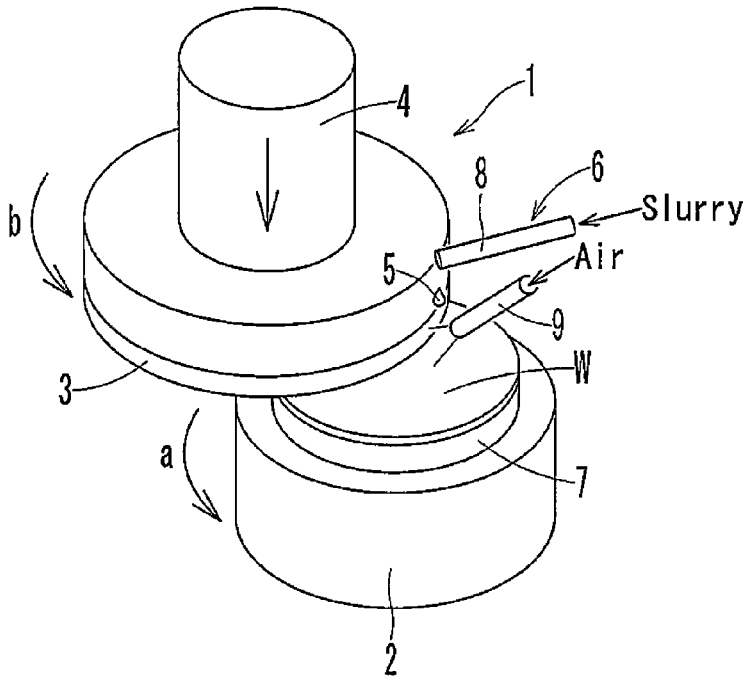
FIG. 1 is a perspective view of a surface grinder showing the first embodiment of the present invention.
Figure 2:
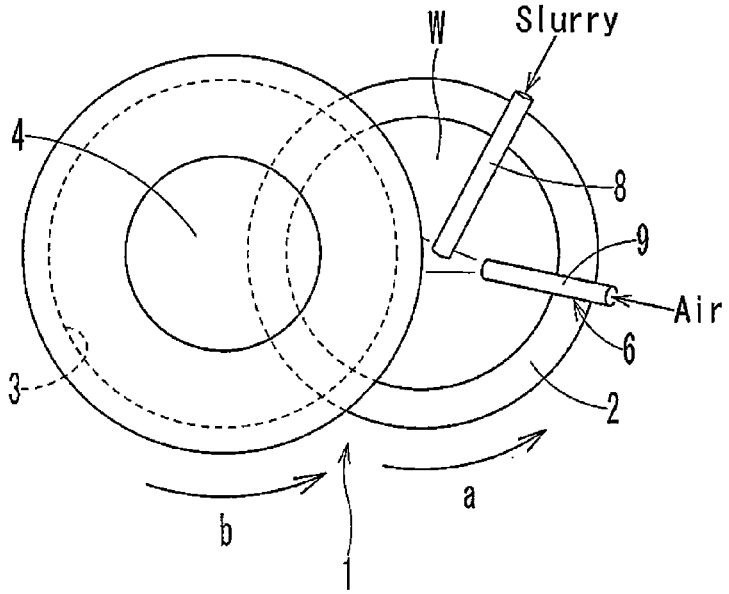
FIG. 2 is a plan view of the same.
Figure 3:
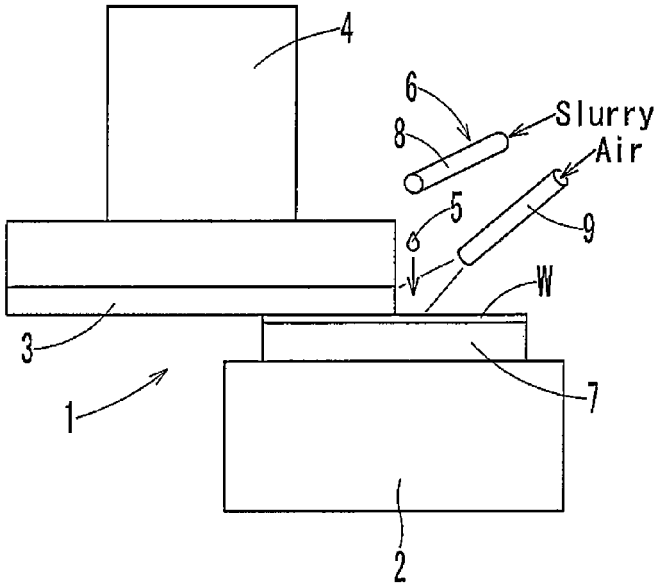
FIG. 3 is a front view of the same.

FIGS. 1 to 3 illustrate the first embodiment of the present invention. FIG. 1 shows a perspective view of a surface grinder, FIG. 2 shows a plan view of the surface grinder, and FIG. 3 shows a front view of the surface grinder, respectively.

As shown in FIGS. 1 to 3, the surface grinder 1 includes a chuck table 2 rotatable about the vertical axis in an arrow a direction, a grinding wheel 3 vertically movably arranged above the chuck table 2 and being rotatable in an arrow b direction, and a supply means 6 configured to drop or spray a slurry 5 containing abrasive grains and supply the same little by little to an upper surface of a workpiece W on the chuck table 2 during the grinding.

The rotation direction of the chuck table 2 and the workpiece W is arbitrary, and it is also possible to rotate one of them or both of them in a direction different from the embodiment as appropriate. The vertical surface grinder 1 in which the chuck table 2 and the grinding wheel 3 are rotated about the vertical axis is exemplified in this embodiment. However, the surface grinder 1 may be of an inclined type in which the chuck table 2 is rotated about an inclined axis.

The chuck table 2 has a chuck means 7 on whose upper surface the workpiece W can be placed substantially concentrically. The chuck table 2 is configured to rotate about the vertical axis in the arrow a direction at the number of revolutions of less than 500 rpm. The chuck means 7 is composed of a suction-type or other appropriate means, and the workpiece W is detachably placed on the upper surface of the chuck means 7. The chuck table 2 may be rotated at a number of revolutions of 500 rpm or more.

The grinding wheel 3 is in a cup shape and is detachably placed at a lower end of a grinding wheel spindle 4. The grinding wheel 3 is arranged at an eccentric position to the workpiece W such that a circumferential edge side of the grinding wheel 3 passes a substantially center part of the workpiece W. While the grinding wheel 3 is rotated at a low peripheral speed of no more than 500 m/min., preferably 30 to 430 m/min., and more preferably on the order of substantially 50 to 250 m/min., in grinding the workpiece W, the grinding wheel spindle 4 is lowered to feed the grinding wheel 3 such that grinding load becomes substantially constant. In a case where the diameter of the grinding wheel 3 is 160 mm for example, the peripheral speed of the grinding wheel 3 is substantially 30 to 430 m/min., by letting the number of revolutions be substantially 60 to 860 rpm.

The supply means 6 is for supplying the slurry 5 little by little in a mist form to the center part or its vicinity of the workpiece W. The supply means 6 has a dropping pipe 8 for dropping the slurry 5 little by little to the center part or its vicinity of the workpiece W from above, and a spray nozzle 9 for injecting air toward the center part or its vicinity of the workpiece W and blowing off the slurry 5 dropped from the dropping pipe 8 in a mist form by this air.

For the hourly flow rate of the slurry 5, a flow rate of no more than 4.0 ml/cm$^2$/h, preferably a flow rate on the order of 1.0 to 2.0 ml/cm$^2$/h is appropriate. The slurry 5 at the flow rate is continuously or intermittently supplied little by little. Accordingly, it is sufficient to drop the slurry 5 little by little from the dropping pipe 8 at a rate of one droplet per few seconds according to the size of the diameter of the workpiece W.

The spray nozzle 9 is arranged on a side substantially opposite to the grinding wheel 3 relative to the center of the workpiece W and injects air toward the center part of the ground surface of the workpiece W. Accordingly, external scattering of the slurry 5 having been atomized above the ground surface of the workpiece W can be prevented by an outer circumferential surface of the grinding wheel 3.

The orientation of the supply means 6, especially its spray nozzle 9 is not a concern as long as the orientation in which the slurry 5 dropped from the dropping pipe 8 can be sprayed on the ground surface of the workpiece W without loss. The slurry 5 may be supplied onto the workpiece W from the dropping pipe 8 by dropping only without provision of the spray nozzle 9.

For the abrasive grains for the slurry 5, #8000 diamond-Gc (SiC) abrasive grains are appropriate, but other abrasive grains (white fused alumina, cubic boron nitride, and ceric oxide etc.) and grain sizes are acceptable. Therefore, kinds and grain sizes of the abrasive grains within the slurry 5 only have to be adjusted appropriately depending on the surface roughness of the workpiece W and the grinding wheel 3 used.

When the workpiece W of the hard brittle material such as a sapphire wafer is ground in this surface grinder 1, the workpiece W is placed on the chuck table 2, first. Subsequently, the grinding wheel 3 is lowered and fed to the workpiece W while the workpiece W is rotated with the chuck table 2 in the arrow a direction at 50 rpm and the grinding wheel 3 in the arrow b direction at a low peripheral speed of 125 m/min. respectively.

On the other hand, the slurry 5 is supplied onto the workpiece W in a mist form from the supply means 6 such that an average supply amount per unit area of the workpiece W becomes no more than 4.0 ml/cm$^2$/h and the flow rate preferably becomes on the order of 1.0 to 2.0 ml/cm$^2$/h during this grinding. For example, the slurry 5 on the order of 0.1 ml is dripped drop by drop at a rate of one time per few seconds from the distal end of the dropping pipe 8, and the dripping slurry 5 is supplied while being blown off in a mist form to the center part of the workpiece W by air injected from the spray nozzle 9, and in this state, the workpiece W is ground by the grinding wheel 3.

Speed control is performed during the grinding of the workpiece W such that the grinding load of the grinding wheel 3 becomes substantially constant. This is because high speed leads to overload and slow speed leads to grinding inefficiency where the feeding speed of the grinding wheel 3 is made constant. The feeding speed may be controlled such that the temperature of the workpiece becomes constant, for example, falls within a fixed range. Further, when the grinding load of the grinding wheel 3 falls within a fixed range, the feeding speed may be substantially constant within that range or may be controlled at multiple stages.

A grinding fluid is not supplied during the grinding of the workpiece W and a cleaning and cooling fluid is supplied for the purpose of cleaning and cooling the workpiece W after completion of the grinding of the workpiece W. However, the grinding fluid or other fluids can be supplied during the grinding of the workpiece W if it is to an extent that does not affect the grinding.

By grinding the workpiece W by means of the grinding wheel 3 rotating at low peripheral speed while supplying the slurry 5 onto the workpiece W little by little in this manner, the problem that the grinding wheel 3 becomes unfit due to a slight change in grinding conditions as in the case of performing the grinding by the grinding wheel 3 rotating at high speed can be solved, and the grinding wheel 3 can be used in such a state that the grinding wheel promotes the self-sharpening appropriately.

Therefore, there are advantages that the sharpness of the grinding wheel 3 can be maintained stably for a long time without dressing and even where the workpiece W is a hard brittle material or difficult-to-cut material, the workpiece W can be machined innovatively and accurately and furthermore the machining rate is significantly improved.

When the grinding wheel 3 is rotated at low peripheral speed while supplying the slurry 5 little by little, for example, wear of the abrasive grains of the grinding wheel is reduced even where a #1500 or more fine grained grinding wheel is used. The abrasive grains within the slurry 5 promote a moderate self-sharpening effect of the grinding wheel 3, so that appropriate sharpness of the grinding wheel 3 can be maintained and the grinding wheel 3 can grind the workpiece W without dressing.

Especially because the grinding wheel 3 is rotated at low peripheral speed, the grinding wheel 3 can be used stably in the state that promotes the appropriate self-sharpening. There is no problem that the grinding wheel 3 becomes unfit due to a slight change in machining conditions, etc., and excellent sharpness can be maintained stably. Therefore, the machining rate is improved significantly as compared to the conventional one.

Further, the grinding wheel 3 with moderate sharpness grinds the ground surface of the workpiece W at a high machining rate while being rotated thereon at low peripheral speed. Thus, even where the workpiece W is a hard brittle material, etc., the brittle fracture that the abrasive grains of the grinding wheel forcibly scratch and tear off the ground surface of the workpiece W etc., can be prevented, and the surface roughness of the ground surface of the workpiece W is improved significantly.

In addition, the workpiece W can be ground efficiently by the sharp grinding wheel 3 rotating at low peripheral speed, so that grinding heat in the workpiece W, etc., can be suppressed and deterioration of grinding accuracy, particularly of flatness (TTV) due to thermal expansion of the chuck table 2 and the workpiece W can be prevented.

Figure 5:
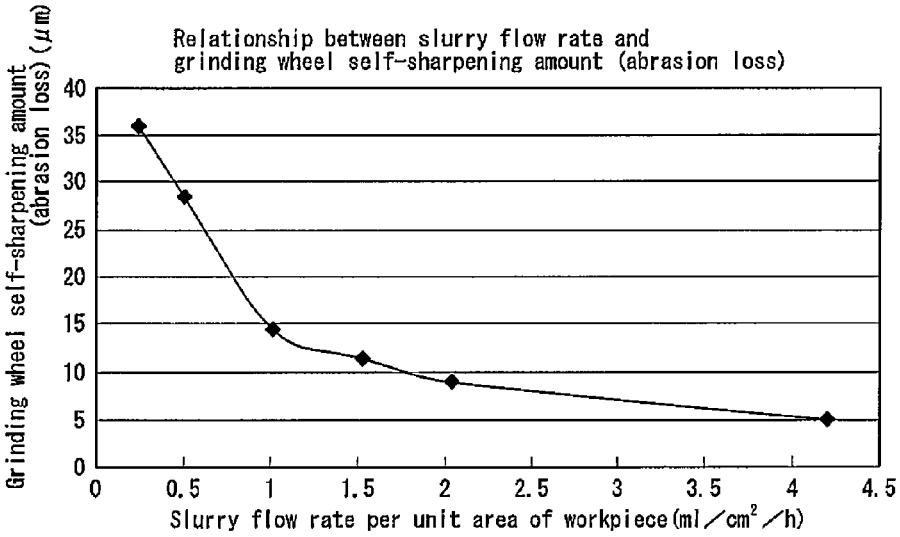
FIG. 5 is a diagram showing the relationship between the slurry flow rate and the grinding wheel self-sharpening amount (abrasion loss).
Figure 6:
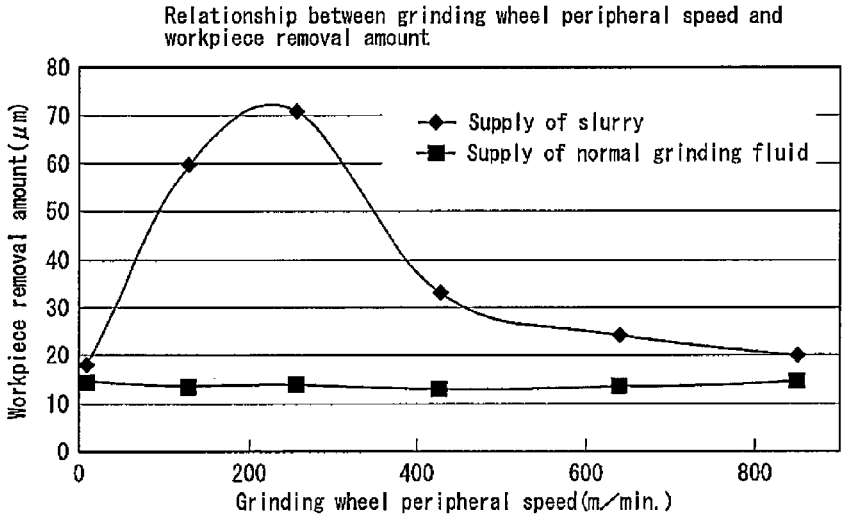
FIG. 6 is a diagram showing the relationship between the grinding wheel peripheral speed and the workpiece removal amount.

In developing the surface grinding method that rotates the grinding wheel 3 at low peripheral speed to grind the workpiece W while supplying the slurry 5 as described above, experiments on the relationship between the grinding wheel peripheral speed and the workpiece temperature/TTV, the relationship between the slurry flow rate and the grinding wheel self-sharpening amount (abrasion loss), and the relationship between the grinding wheel peripheral speed and the workpiece removal amount were carried out. Results as shown in FIGS. 4 to 6 were obtained.

Figure 4:
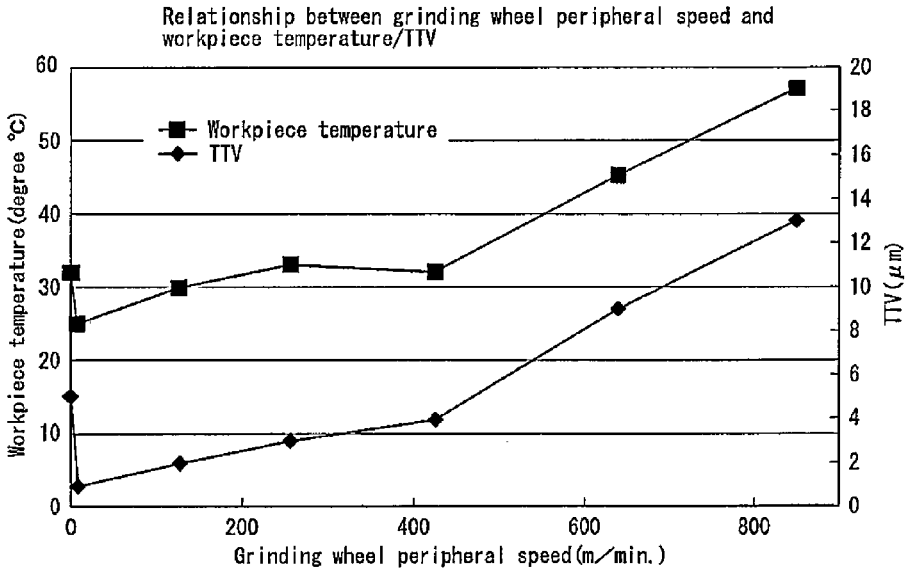
FIG. 4 is a diagram showing the relationship between the grinding wheel peripheral speed and the workpiece temperature/TTV.

FIG. 4 shows the relationship between the grinding wheel peripheral speed and the workpiece temperature/TTV. The number of revolutions of a sapphire workpiece W was set at 50 rpm and the peripheral speed of the grinding wheel 3 and workpiece W was set at seven levels in a range from 0 m/min., to 850 m/min., and the workpiece W was ground by the grinding wheel 3 at each peripheral speed while supplying the slurry 5. The workpiece temperature and TTV at every peripheral speed were measured. Results as shown in FIG. 4 were obtained.

As a result, the workpiece W was able to be ground at a peripheral speed of 0 m/min. It was found that the grinding accuracy, particularly the flatness of the workpiece W deteriorated at a peripheral speed faster than 500 m/min., since the workpiece temperature was increased rapidly and along therewith the TTV was increased. On the other hand, it was found that the workpiece temperature was stabilized and along therewith the TTV was reduced when the peripheral speed of the grinding wheel 3 was set at no more than 500 m/min., preferably to 430 m/min., and more preferably on the order of substantially 50 to 250 m/min.

Accordingly, it can be seen from the results of FIG. 4 that the workpiece temperature and TTV can be kept low and the grinding accuracy of the workpiece W can be secured when the grinding wheel 3 is rotated at a peripheral speed of no more than 500 m/min., preferably 30 to 430 m/min., and more preferably no more than on the order of substantially 50 to 250 m/min.

FIG. 5 shows the relationship between the slurry flow rate and the grinding wheel self-sharpening amount (abrasion loss). The number of revolutions of a sapphire workpiece W was set at 50 rpm and the peripheral speed of the grinding wheel 3 was set at 125 m/min., and grinding of each workpiece W was performed while changing the slurry flow rate at six levels. The grinding wheel self-sharpening amount (abrasion loss) at each slurry flow rate was measured. Results as shown in FIG. 5 were obtained.

From the results, it was found that there were tendencies that the sharpness of the grinding wheel 3 was improved due to the self-sharpening effect by the abrasive grains within the slurry 5 but the wear of the grinding wheel was increased when the slurry flow rate was reduced, whereas the self-sharpening effect by the abrasive grains was lowered and the wear of the grinding wheel was reduced when the slurry flow rate was increased.

Accordingly, the results of FIG. 5 revealed that a flow rate of no more than 4.0 $ml/cm^2/h$, preferably on the order of 1.0 to 2.0 $ml/cm^2/h$ was appropriate for the slurry flow rate in order to secure an appropriate self-sharpening effect of the grinding wheel 3 and suppress the wear of the grinding wheel 3 as much as possible with consideration given to the tradeoff between the cost of the grinding wheel and the cost of the slurry.

FIG. 6 shows the relationship between the grinding wheel peripheral speed and the workpiece removal (grinding) amount. The number of revolutions of a sapphire workpiece W was set at 50 rpm and the slurry flow rate was set at 1.0 $ml/cm^2/h$, the peripheral speed of the grinding wheel 3 and workpiece W was set at six levels in a range from 10 m/min., to 850 m/min., grinding of the workpiece W was performed and the workpiece removal amount at every peripheral speed was measured. Results as shown in FIG. 6 were obtained.

Further, FIG. 6 also shows in contrast the relationship between the grinding wheel peripheral speed and the workpiece removal amount in the case of grinding the workpiece W at each peripheral speed while supplying a normal grinding fluid. Respective workpiece removal amounts are ones where the grinding load of the grinding wheel 3 is constant and the feeding amount is the same.

From this result of FIG. 6, it was found that when the grinding wheel 3 was rotated at low peripheral speed to perform the grinding while supplying the slurry 5, the sharpness of the grinding wheel 3 was improved, the workpiece removal amount was increased and the grinding was performed efficiently as compared to the case of performing the grinding at low peripheral speed while supplying the normal grinding fluid.

Further, it was found that even when the slurry 5 at the same flow rate was supplied, the workpiece removal amount particularly at the time of rotating the grinding wheel 3 at a peripheral speed in the neighborhood of 250 m/min., became maximum, and the workpiece removal amount was reduced at a peripheral speed under 30 m/min., and more than 430 m/min., and the workpiece removal amount was changed greatly at between peripheral speeds of 30 m/min., and 430 m/min., centering around a peripheral speed of 250 m/min.

This is conceived as a tendency for the workpiece removal amount in the peripheral speed range to be reduced due to that the wear of the grinding wheel by the abrasive grains etc., within the slurry 5 is increased when the peripheral speed falls under 30 m/min., and the slip and slide of the grinding wheel 3 become large when the peripheral speed exceeds 430 m/min.

Accordingly, it was found from the results of FIG. 4 and FIG. 6 that a sharp state of the grinding wheel 3 was able to be maintained stably and the machining rate was significantly improved by rotating the grinding wheel 3 at a peripheral speed of no more than 500 m/min., preferably of 30 to 430 m/min., and more preferably on the order of substantially 50 to 250 m/min.

Further, since the workpiece W can be ground by the sharp grinding wheel 3, the brittle fracture on the ground surface side of the workpiece W can be prevented and grinding in which the surface roughness and the flatness are significantly improved is possible as compared to the case of performing the grinding while supplying the normal grinding fluid, etc.

Figure 7:
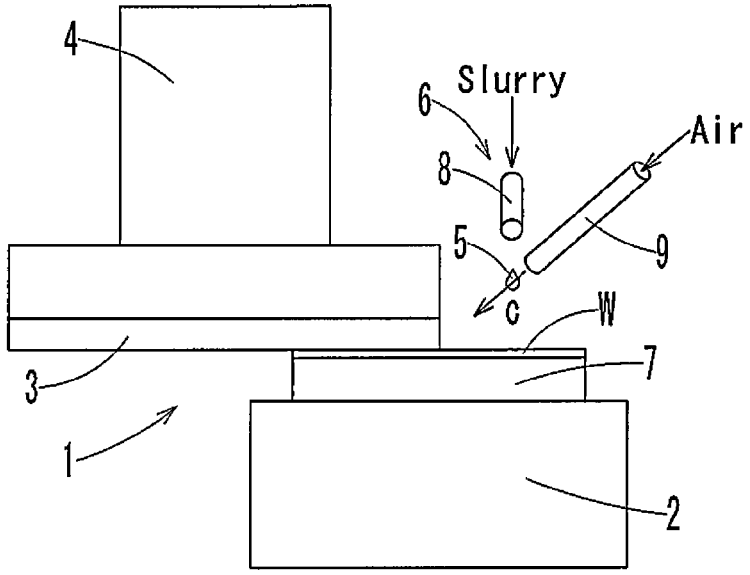
FIG. 7 is a front view of a surface grinder showing the second embodiment of the present invention.

FIG. 7 exemplifies the second embodiment of the present invention. When the slurry 5 dripped drop by drop from the dropping pipe 8 is supplied while being atomized by blowing air from the spray nozzle 9, it is also acceptable that distal ends of the dropping pipe 8 and spray nozzle 9 are arranged away to the opposite side from the grinding wheel 3 relative to the center of the workpiece W, and the slurry 5 dropped from the distal end of the dropping pipe 8 is blown off in the arrow c direction to the vicinity of the center of the ground surface of the workpiece W by air from the spray nozzle 9. By doing so, the dropping pipe 8 and the spray nozzle 9 can be set apart from the grinding wheel 3.

Hereinbefore, the embodiments of the present invention have been described in detail. The present invention should not be limited thereto and various modifications can be made. For example, the supply of the slurry 5 by the supply means 6 may be such that the slurry 5 is directly dropped on the ground surface of the workpiece W or the slurry 5 is sprayed in a mist form by the spray nozzle 9. Thus, the supply form of the slurry 5 makes no difference and it is sufficient if it can be supplied little by little.

Further, the material of the workpiece W makes no difference in the present invention. In addition to the grinding of hard brittle materials such as a sapphire wafer, the present invention can be applied to the grinding of difficult-to-cut materials such as SiC and GaN. The present invention may be employed in the grinding of easy-to-cut materials. The abrasive grains contained in the slurry 5 may be ones other than diamond, for example, GC abrasive grains. The grain size thereof may be as large as the grinding wheel 3, or may be larger or smaller than the grinding wheel 3.

The reduction in machining accuracy such as the deterioration of flatness of the workpiece W due to grinding heat can be prevented when the grinding method like the embodiments is employed. In order to further improve the machining accuracy, however, it is also possible to separately provide a mechanism for correcting the finished shape of the workpiece W.

It can be thought of as the correcting means that a cooling apparatus is installed to suppress an increase in machining heat, for example. Further, a cooling method includes a method that applies cold air to the workpiece W, a method that incorporates a cooling mechanism (a water-cooled type, a Peltier type, etc.) to a workpiece drive, and a method that cools and supplies the slurry 5, etc.

Further, a workpiece shape correcting method by performing the grinding with the grinding wheel spindle 4 or a workpiece drive spindle inclined, and a workpiece shape correcting method by forming a workpiece contact surface of the workpiece drive into a middle concave shape etc., are thought of. When the workpiece contact surface is formed into the middle concave shape, it is only necessary to form a workpiece contact surface of the chuck into a middle concave shape by as much as the amount of reduction in flatness.

It is also possible to control the conditions of the slurry 5 to be supplied onto the ground surface of the workpiece W from the supply means 6 depending on the situation during the grinding of the workpiece W or at an appropriate time such as when the grinding of the workpiece W is completed and the process moves on to grinding of another workpiece W. More specifically, the size, amount, component, and supply amount of abrasive grains may be varied to change the abrasion loss of the grinding wheel.

For example, as obvious from the results of FIG. 5, the self-sharpening amount (abrasion loss) of the grinding wheel 3 varies depending on the magnitude of the supply amount even when the same kinds of slurry 5 are supplied. Therefore, a flow rate control means may be provided midway of the supply means 6 to capture a change in the self-sharpening amount (abrasion loss) of the grinding wheel 3 and control the flow rate of the slurry 5 such that the self-sharpening amount (abrasion loss) becomes substantially constant.

Further, a component which chemically reacts with grinding wheel components (especially, the bond component thereof, etc.) may be mixed into the slurry 5, and the slurry 5 mixed with the component may be supplied onto the ground surface of the workpiece W. In this case, it becomes possible to increase or decrease the protrusion height of the abrasive grains of the grinding wheel by the chemical reaction with the bond component of the grinding wheel 3, and thus, the sharpness of the grinding wheel 3 can be changed.

DESCRIPTION OF REFERENCE NUMERALS

1 Surface grinder
2 Chuck table
3 Grinding wheel
5 Slurry
6 Supply means
W Workpiece

What is claimed is:

1. A surface grinding method for a workpiece that grinds an upper surface of the workpiece by a cup grinding wheel being rotated to pass a center part of the workpiece while supplying a slurry containing abrasive grains to the upper surface of the workpiece being rotated and a circumference of the center part of the workpiece, characterized by rotating the grinding wheel at a peripheral speed of no more than 500 m/min, dripping the slurry intermittently at or at less than 4.0 $ml/cm^2$ per hour from a dropping pipe to a center part or its vicinity of the workpiece and near the grinding wheel, blowing air, injected from a spray nozzle, from a side substantially opposite side to the grinding wheel toward a center side of the workpiece in the direction of the center part of the workpiece, blowing air injected from the spray nozzle to the slurry while being dropped from the dropping pipe and before being dropped on the upper surface of the workpiece, and supplying the slurry to a ground portion of the workpiece while blowing off the slurry in a mist form by the air.

2. The surface grinding method for the workpiece according to claim 1, characterized in that the peripheral speed of the grinding wheel is 30 to 430 m/min.

3. The surface grinding method for the workpiece according to claim 1, characterized in that the slurry is sprayed on the workpiece.

4. The surface grinding method for the workpiece according to claim 1, characterized in that self-grinding of the grinding wheel occurs during the grinding of the workpiece.

5. The surface grinding method for the workpiece according to claim 2, characterized in that self-grinding of the grinding wheel occurs during the grinding of the workpiece.

6. The surface grinding method for the workpiece according to claim 3, characterized in that self-grinding of the grinding wheel occurs during the grinding of the workpiece.

7. The surface grinding method for the workpiece according to claim 2, characterized in that the slurry is dropped or sprayed on the workpiece.

8. The surface grinding method for the workpiece according to claim 7, characterized in that self-grinding of the grinding wheel occurs during the grinding of the workpiece.

* * * * *